US005510879A

United States Patent [19]

Facci et al.

[11] Patent Number: 5,510,879

[45] Date of Patent: Apr. 23, 1996

[54] PHOTOCONDUCTIVE CHARGING PROCESSES

[75] Inventors: John S. Facci, Webster; Richard B. Lewis, Williamson; Milan Stolka, Fairport; Martin A. Abkowitz; Michael J. Levy, both of Webster; Joseph Mammino, Penfield; Michael M. Shahin, Pittsford, all of N.Y.

[73] Assignee: Xerox Corporation, Stamford, Conn.

[21] Appl. No.: 250,749

[22] Filed: May 27, 1994

[51] Int. Cl.[6] ..... G03G 15/02; G03G 13/02

[52] U.S. Cl. ..... 355/219; 361/225; 430/902

[58] Field of Search ..... 355/219; 361/225; 430/902

[56] References Cited

U.S. PATENT DOCUMENTS

| | | | |
|---|---|---|---|
| 2,904,431 | 9/1959 | Moncrieff-Yeates . | |
| 2,987,660 | 6/1961 | Walkup . | |
| 3,394,002 | 7/1968 | Bickmore | 96/1 |
| 4,086,650 | 4/1978 | Davis et al. | 361/229 |
| 4,265,990 | 5/1981 | Stolka et al. | 430/59 |
| 4,585,320 | 4/1986 | Altavela et al. | 355/3 CH |
| 5,377,070 | 12/1994 | Kawamoto | 355/219 X |

OTHER PUBLICATIONS

Photographic Science and Engineering, "Characteristics of Corona Discharge and Their Application to Electrophotography", Michael M. Shahin, vol. 15, No. 4, Jul.–Aug. 1971, pp. 322–328.

Current Problems in Electrophotography, R. B. Lewis & H. M. Stark, Walter de Gruyter, 1972, p. 328.

*Primary Examiner*—Joan H. Pendegrass

*Attorney, Agent, or Firm*—E. O. Palazzo

[57] ABSTRACT

A process for charging layered imaging members by the transfer of ions thereto from an ionically conductive medium.

13 Claims, 2 Drawing Sheets

PHOTOCONDUCTIVE CHARGING PROCESSES

BACKGROUND OF THE INVENTION

This invention is generally directed to processes for charging imaging members such as photoreceptors, photoconductive imaging members and dielectric charge receivers for ionography. More specifically, in embodiments the present invention relates to processes for charging photoconductive imaging members, especially and preferably layered imaging members by ionic conduction and wherein, for example, corona charging and discharging devices together with their known disadvantages can be avoided and/or minimized. Embodiments of the present invention include a process for the ion transfer charging of photoconductive imaging members, which process comprises contacting a component, such as a liquid like water, with the surface of the imaging member; and applying a voltage to the component while moving, such as rotating the imaging member thereby enabling the transfer of ions, preferably of a single sign, such as positive or negative, from the liquid/imaging member interface to the imaging member.

The charging of photoconductive imaging members by means of corona discharge methods is known, however, a number of disadvantages are associated with these methods, such as the generation of ozone, the use of high voltages, such as from about 6,000 to about 7,000 volts, which requires the use of special insulation, maintenance of the corotron wires at added costs, low charging efficiency, the need for erase lamps and lamp shields, and the like. Since it is a health hazard, ozone is removed by passage through a filter. Corona charging generates oxides of nitrogen which desorb eventually from the corotron surfaces and eventually oxidize the transport molecule thereby adversely effecting the electrical properties of the photoreceptor. These can show up as print deletions.

Generally, the process of electrostatographic copying is initiated by placing a substantially uniform electrostatic charge on a photoreceptive member. Subsequent to this charging, imaging is accomplished by exposing a light image of an original document onto the substantially uniformly charged photoreceptive member. Exposing the charged photoreceptive member to a light image discharges the photoconductive surface thereon in areas corresponding to nonimage areas in the original document while maintaining the charge in image areas, thereby creating an electrostatic latent image of the original document on the photoreceptive member. This latent image is subsequently developed into a visible image by depositing charged developing material onto the photoreceptive member such that the developing material is attracted to the charged image areas on the photoconductive surface. Thereafter, the developing material is transferred from the photoreceptive member to a copy sheet or to some other image support substrate for creating a visible image which may be permanently affixed to the image support substrate, thereby providing a reproduction of the original document. In a final step in the process, the photoconductive surface of the photoreceptive member can be cleaned to remove any residual developing material which may be remaining on the surface thereof in preparation for successive imaging cycles.

Illustrated in copending patent application U.S. Ser. No. 176,188 filed Jan. 3, 1994, the disclosure of which is totally incorporated herein by reference, is a corona generating device and, more particularly, a reusable corona charging apparatus for use in an electrostatographic printing machine to generate a flow of ions onto an adjacent imaging surface so as to alter the electrostatic charge thereon.

The electrostatographic copying process described hereinabove is well known and is commonly used for light lens copying of an original document. Analogous processes also exist in other electrostatographic printing applications such as, for example, digital laser printing where a latent image is formed on the photoconductive surface via a modulated laser beam, or ionographic printing, and reproduction where charge is deposited on a charge retentive surface in response to electronically generated or stored images.

In addition to charging the imaging surface of an electrostatographic system prior to exposure, corona devices are used to perform a variety of other functions in the electrostatographic process. For example, corona generating devices aid in the transfer of an electrostatic toner image from a reusable photoconductive imaging member to a transfer member such as paper; the tacking and detacking of the transfer member to and from the imaging member; and the conditioning of the surface of the imaging member prior to, during, and after deposition of toner thereon to improve the quality of the electrostatographic copy produced thereby. Each of these functions can be accomplished by a separate and independent corona generating device. The relatively large number of devices within a single machine necessitates the economical use of corona generating devices.

Various types of charging devices have been used to charge or precharge the surface of a photoconductive member. Corona generating devices are used extensively, wherein a voltage of 2,000 to 10,000 volts may be applied across an electrode to produce a corona spray which imparts electrostatic charge to a surface situated in close proximity thereto. One particular corona generating device includes a single corona generating electrode strung between insulating end blocks mounted on either end of a channel formed by a U-shaped shield or a pair of spaced side shield members. The corona generating electrode is typically a highly conductive, elongated wire positioned opposite the surface to be charged. In other conventional corona generating devices, the corona generating electrode may also be in the form of a pin array. Another device, frequently selected to provide more uniform charging and to prevent overcharging, includes two or more corona generating electrodes with a control grid comprising a screen having a plurality of parallel wires or a plate having multiple apertures positioned between the corona generating electrodes and the photoconductive member. In this device, a potential having the same polarity as that applied to the corona electrodes but having a much smaller voltage magnitude, usually about a few hundred volts, is applied to the control grid to suppress the electric field between the control grid and the corona electrodes, markedly reducing the ion current flow to the photoconductive member.

Yet another type of corona generating device is described in U.S. Pat. No. 4,086,650 wherein a corona discharge electrode is coated with a relatively thick dielectric material such as glass for substantially preventing the flow of conduction current therethrough. In this device, the delivery of charge to the photoconductive member is accomplished by a displacement current or by capacitive coupling through the dielectric material. The flow of ions to the surface to be charged is regulated by means of a DC bias applied to the shield of the corona generating device. In operation, an AC potential of approximately 5,000 to 7,000 volts is applied to the coated electrode at a frequency of about 4 KHz to produce an actual corona generating current of approximately 1 to 2 milliamperes. This device has the advantage of providing a uniform charge to the photoconductive member using a charge generating device that is highly insensitive to contamination by dirt and, therefore, does not require repetitive cleaning or other maintenance requirements.

One problem associated with corona generating devices occurs in the presence of the generated corona, wherein a region of high chemical reactivity is also produced such that new chemical compounds are synthesized in the machine air. This chemical reactivity correspondingly causes a build up of chemical growth on the corona generating electrode as well as other surfaces adjacent thereto. After a prolonged period of operation, these chemical growths may degrade the performance of the corona generating device and also the entire electrostatographic machine.

Free oxygen, ozone, and other corona effluents, such as nitrogen oxide, and nitrogen oxide species, can be produced in the corona region. These nitrogen oxide species react with solid surfaces. In particular, it has been observed that these nitrogen oxide species are adsorbed by the conductive control grid, the shield, shield members and other components of the corona generating device. The adsorption of nitrogen oxide species occurs even though the corona generating device may be provided with a directed air flow during operation for removing the nitrogen oxide species as well as controlling ozone emissions. During the process of collecting ozone, directed air flow may exacerbate problems by carrying the nitrogen oxide species to an affected area of the corona generating device or even to some other machine part.

The reaction of corona generating process byproducts, such as nitrogen oxide, with the shield, the control grid, or other corona generating device components can result in corrosive buildup and deposition on the surfaces thereof. These deposits can cause problems, such as nonuniform photoreceptor charging, manifested by side-to-side density variations, or dark and light streaks in an output copy. Also, depending on environmental conditions, deposits may charge up and effectively increase the shield or screen voltage resulting in similar nonuniformity defects. Extreme cases of corrosion can lead to arcing between the corona generating electrode and the screen on the shield members.

Another problem associated with corona generating devices operating in a electrostatographic environment results from toner accumulation on the surface of the corona generating electrode as well as surfaces adjacent thereto. The spots of accumulated toner, being a dielectric in nature, tend to cause localized charge buildup on the interior surfaces of the shield which produces current nonuniformity and reduction in corona current. Localized toner accumulations on the insulating end blocks which support the wire electrode also cause sparking.

Moreover, adsorption can be a physically reversible process such that the adsorbed nitrogen oxide species are gradually desorbed when a machine is turned off for an extended period of idleness. The adsorbed and desorbed species are both nitrogenous but not necessarily the same, that is there may be a conversion of $NO_2$ to $HNO_3$. When the operation of the machine is resumed, a copy quality defect, commonly referred to as a parking deletion, can result wherein a line image deletion or a lower density image is formed across the width of the photoreceptor at that portion of its surface resting opposite the corona generating device during the period of idleness. It is believed that the nitrogen oxide species interact with the surface of the photoreceptor to increase the lateral conductivity thereof such that the photoreceptor cannot effectively retain a charge in image configuration. This phenomenon basically causes narrow line images to blur or to wash out so as to not be developed as a toner image.

In corona generating devices, it has been found that the material from which the components, such as the shield or control grid, are fabricated has a significant effect on the severity of parking deletions. In the prior art, stainless steel materials, such as shields, have commonly been used. Other materials, such as corrosion resistant ferrous materials which prevent the rapid oxidation of the component material and the concurrent loss of performance of the corona generator, have met with limited success, primarily due to the corrosive effect of the corona produced by the device.

In other attempts to reduce the problems associated with corona charging, considerable effort has been accomplished to reduce the adsorption of nitrogen oxides species by device components via the application of electrodag coatings to the surfaces thereof. These coatings typically include a reactive metal base such as nickel, lead, copper, zinc or mixtures thereof. These reactive metal base materials tend to absorb, or form harmless compounds with the nitrogen oxide species. However, parking deletion problems have continued due, for example, to the failure of the electrodag materials to continue to absorb or form harmless compounds with the nitrogen oxide species over time. In addition, certain components needed to address this problem are costly to fabricate.

Thus, the problem of chemical growth buildup in and around corona generating devices has been addressed by providing coating materials that are less prone to chemical attack. While adequately addressing the problem, such materials have substantially increased the cost of corona generating devices. Various forms of corona generating devices have been described for use in electrostatographic reproduction machines.

U.S. Pat. No. 4,258,258 discloses a corona generating device having a corona generating electrode supported between a pair of end block assemblies. Each end block assembly defines a space for the passage of the electrode, and nonconductive inserts for surrounding the electrodes that are seated in the spaces of the end block assemblies. The nonconductive inserts are made from a high dielectric strength material that is also resistant to a corrosive atmosphere. The inserts are easily and inexpensively replaced so as to protect the end block assemblies from the effects of high voltage applied to the corona electrode.

U.S. Pat. No. 4,585,320 discloses a corona generating device for depositing negative charge on an imaging surface carried on a conductive substrate comprising at least one elongated conductive corona discharge electrode, means to connect the electrode to a corona generating potential source, at least one element adjacent the corona discharge electrode capable of adsorbing nitrogen oxide species once the corona generating electrode is energized and capable of desorbing nitrogen oxide species once that electrode is not energized, the element being plated with a substantially continuous layer of lead to neutralize the nitrogen oxide species when generated. In a preferred embodiment, the corona discharge electrode comprises a thin wire coated at least in the discharge area with a dielectric material and at least one element comprising a conductive shield, and an insulating housing having two adjacent sides to define the longitudinal opening to permit ions from the electrode to be directed toward a surface to be charged, both the shield and the two sides of the housing being plated with a continuous thin layer of lead.

U.S. Pat. No. 4,585,322 discloses a corona generating device similar to that discussed in previously referenced and described U.S. Pat. No. 4,505,320, wherein the element adjacent the corona discharge electrode capable of adsorbing nitrogen oxide species once the corona generating electrode is energized and capable of desorbing nitrogen oxide species once that electrode is not energized is coated with a substantially continuous thin dehydrated alkaline film of an alkali silicate to neutralize the nitrogen oxide species when generated.

U.S. Pat. No. 4,585,323 discloses a corona generating device similar to that described in above referenced and described U.S. Pat. No 4,585,320 and U.S. Pat. No 4,585, 322, wherein the element adjacent the corona discharge electrode capable of adsorbing nitrogen oxide species once the corona generating electrode is energized and capable of desorbing nitrogen oxide species once that electrode is not energized is coated with a substantially continuous thin layer of a paint containing reactive metal particles which will combine with the nitrogen oxide species, the reactive metal being present in the paint in an amount sufficient to neutralize the nitrogen oxide species when generated. Preferably, the reactive metal particles comprise lead, copper, nickel, gold, silver, zinc or mixtures thereof. Also of interest are U.S. Pat. Nos. 2,987,660, see for example column 2, lines 50 to 68, column 3, lines 49 to 70, and specifically column 3, lines 59 to 61, wherein water is mentioned as a conductive liquid; 3,394,002; and 2,904,431.

Generally, layered photoresponsive imaging members are described in a number of U.S. patents, such as U.S. Pat. No. 4,265,900, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006 a composite xerographic photoconductive member comprised of finely divided particles of a photoconductive inorganic compound dispersed in an electrically insulating organic resin binder. The binder materials disclosed in the '006 patent comprise a material which is incapable of transporting for any significant distance injected charge carriers generated by the photoconductive particles.

Photoresponsive imaging members with squaraine photogenerating pigments are also known, reference U.S. Pat. No. 4,415,639. In this patent, there is illustrated a photoresponsive imaging member with a substrate, a hole blocking layer, an optional adhesive interface layer, an organic photogenerating layer, a photoconductive composition capable of enhancing or reducing the intrinsic properties of the photogenerating layer, and a hole transport layer. As photoconductive compositions for the aforementioned member, there can be selected various squaraine pigments, including hydroxy squaraine compositions.

Moreover, there are disclosed in U.S. Pat. No. 4,419,427 electrographic recording mediums with a photosemiconductive double layer comprised of a first layer containing charge carrier perylene diimide dyes, and a second layer with one or more compounds which are charge transporting materials when exposed to light, reference the disclosure in column 2, beginning at line 20.

The disclosures of each of the above patents are totally incorporated herein by reference.

SUMMARY OF THE INVENTION

Examples of objects of the present invention include:

It is an object feature of the present invention to provide processes for imaging member charging with many of the advantages illustrated herein.

It is yet another object of the present invention to provide processes for the charging of layered imaging members.

Another object of the present invention relates to the ion transfer charging of photoreceptors.

Moreover, in another object of the present invention there are provided processes wherein corona charging devices for the charging of layered photoconductive imaging members can be eliminated.

Additionally, in another object of the present invention ionically conductive liquids and ionically conductive polymers are selected for the charging of photoconductors, including layered photoconductive imaging members comprised of a photogenerating layer and a charge transport layer, reference for example U.S. Pat. No. 4,265,990.

Also, in another object of the present invention, ionically conductive liquids and ionically conductive polymers are selected for the charging of photoconductors, including layered photoconductive imaging members comprised of a photogenerating layer and a charge transport layer, reference for example U.S. Pat. No. 4,265,990, and wherein the mechanism of charging is the transfer of ions to the imaging member.

A further object of the present invention resides in the provision of processes for charging imaging members by the transfer of ions thereto, and which members can be selected for a number of imaging processes including xerographic imaging and printing methods such as full color, highlight color, trilevel color processes, and ionographic imaging methods.

These and other objects of the present invention can be accomplished in embodiments thereof by the provision of processes for the charging of imaging members. In embodiments, the process of the present invention comprises the charging of photoreceptors by the transfer of ions thereto. More specifically, in embodiments the process of the present invention comprises the ionic conduction charging of photoconductive imaging members, which process comprises contacting a component, such as a liquid like water, with the surface of the imaging member; and applying a voltage to the component while rotating or translating the imaging member thereby enabling the transfer of ions, preferably of a single sign, such as positive or negative polarity, from the liquid/imaging member interface to the imaging member. The photoreceptor thus becomes charged by the voltage applied to the liquid component in contrast to applying a voltage directly to the photoreceptor by a corotron. In embodiments, an ionic liquid, such as distilled water contained in an absorbent sponge, blades, rolls and the like, is biased by a voltage about equal to the surface potential desired on the photoreceptor, and ions of the desired polarity are deposited at the point of contact until they reduce the field across the molecular dimensioned fluid gap to zero (0).

Brief Description of the Drawings FIG. 1 is a graph of charging of aluminized Mylar® with electrified water.

DETAILED DESCRIPTION OF PREFERRED EMBODIMENTS

Figure 1:
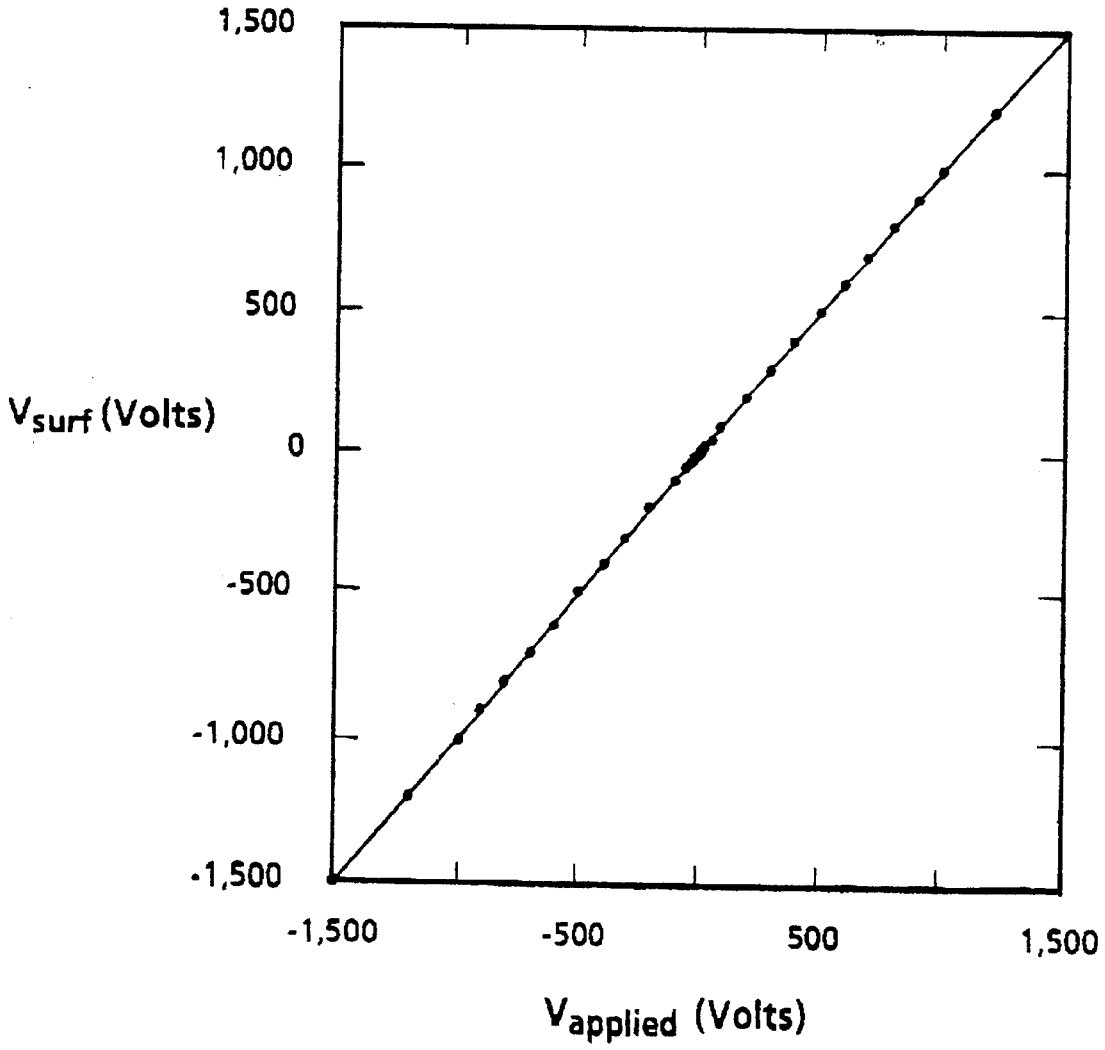

Specific embodiments of the present invention are directed to a process for charging layered photoreceptors by the transfer of ions thereto from an ionically conductive medium, and wherein this medium is comprised of a liquid like water including distilled water, or an ionically conductive polymer and a process for the ion transfer charging of photoconductive imaging members, which comprises contacting an ionically conductive medium with the surface of the imaging member; and applying a voltage to the medium while moving like translating or rotating the imaging member past the ionically conductive medium thereby enabling the transfer of ions to the member of crucial importance to the present invention in embodiments is the selection and charging of layered imaging members rather than drums like selenium.

Examples of ionically conductive media include distilled deionized water, tap water, other similar effective media, and the like. Components, which can be added to the water phase to render it ionically conductive, include a number of components like carbon dioxide ($CO_2$), alkali metal carbonates like lithium carbonate, sodium carbonate, potassium carbonate, sodium bicarbonate and the like. The concentration ranges for such components can vary from trace levels to saturation. The applied voltage can range from about minus 4,000 volts to positive 4,000 volts. Another example of an ionically conductive medium is a gel that is comprised of an effective amount, such as 4 weight percent of polyacrylic acid neutralized with a base such as NaOH containing an effective amount, such as 96 weight percent of water. Various doubly charged ions, such as $Ca_{2+}$, in the form of $Ca(OH)_2$ basic components like amines, and the like can be added to the gel to enhance the ionic conductivity of the gel and to enhance the crosslinking of the gel. The charge applied to the medium from a power source can be of a positive polarity or a negative polarity, and is of a value of, for example, from about 200 volts to about 750 volts. This charge equates with the charge that is applied to the imaging member, thus if a charge of 750 volts is applied to the ionically conductive medium a charge of about 750 volts or slightly less, such as about 725 volts to 749 volts, is applied to the imaging member. The sign of the charge which is deposited is controlled by the sign of the voltage which is applied. Application of a positive bias to the ionically conductive medium causes positive ions to transfer to the imaging member. Application of a negative bias to the ionically conductive medium causes negative ions to transfer to the imaging member. The circumferential rotating speed of the photoreceptor can range from very low values like greater than zero speed to high speeds such as 20 inches per second. The thickness of the interface, which is responsible for the transfer of ions, is of molecular dimensions and can vary from about 100 Å to about 5 Å depending on the concentration of the ions in the solution, the lower concentrations providing the thicker interfaces. For example, when the photoreceptor is moving at 20 inches per second and the nip width of the charging medium is 0.1 inch (typical) then the imaging member is in contact with the charging element for about 5 milliseconds. Also, when the photoreceptor is moving at 1 inch per second and the nip width is 1 inch, the imaging member is in contact with the charging element for 1 second.

A conductive material is contacted with the liquid or the species carrying the liquid in order to apply the voltage to the liquid. The conductive material can be copper wire, or a container fabricated of brass, stainless steel, aluminum and the like. The container can be comprised of conductive composite materials such as a carbon loaded polymer or plastic. The conductivity can be as low as about 1 micromho/cm. The maximum voltage to which the imaging member can be charged is the applied voltage. The charging of the imaging member is limited to this value since the electric field at the interface between the ionically conductive medium and the imaging member drops to zero when the voltage on the imaging member reaches the applied voltage, and neglecting any IR or voltage drops in the ionically conductive medium itself. The imaging member can be undercharged if insufficient time is allowed for contact between the imaging member and the ionically conductive medium. The degree of undercharging is usually not significant (25 to 50 volts) and can be compensated for by the application of a higher voltage to the ionically conductive medium. The evidence that no ozone is formed between −800 volts and +800 volts is that no corona is observed and/or the odor of ozone is not present.

In embodiments, the process of the present invention is considered highly efficient when two conditions are met. The first is that of insignificant voltage drop in the ionically conductive medium, which is satisfied in pure distilled water where the IR drop at 20 inches per second is no more than about 25 volts. This represents a waste of about 4 percent of the applied voltage when the applied voltage is 625 volts. The voltage drop across the ionically conductive medium can be reduced and the efficiency increased by increasing the ionic conductivity of the ionically conductive medium, which can be accomplished, for example, by adding a low concentration of an ionic species, for example, about 0.1 mM. The second condition is that the imaging member and the ionically conductive medium remain in contact for a sufficient period of time so that the voltage developed on the imaging member reaches the applied voltage less the IR drop in the ionically conductive medium. The Table that follows illustrates the calculated current expected at various process speeds. The assumptions are an applied voltage of 1,000 volts, a relative dielectric constant of 3.0, an imaging member thickness of 25 microns and a 16 inch long charging mechanism (1,000 $cm^2$/panel).

| PROCESS SPEED | CURRENT | POWER |
|---|---|---|
| 2 ips | 20 uA | 20 mW |
| 10 ips | 100 uA | 100 mW |
| 20 ips | 200 uA | 200 mW |

An erase lamp can be eliminated because the ionically conductive medium is able to charge imaging members to any voltage including zero (0) volts. Thus, it is possible to ground the ionically conductive liquid and withdraw the imagewise residual charge remaining on the imaging member back into the ionic medium. Therefore, an erase lamp is not needed to photodischarge the residual charge.

The present invention encompasses both ionically conductive liquids (fluid-based ion donors) and ionicallly conductive solids (solid-state ion donors). Fluid ion donors are composed of a carrier fluid solvent and soluble ionizable species or electrolytes. Suitable solvents include water, alcohols such as ethanol, isopropanol, and polyols such as glycerol, ketones such as acetone, aromatic hydrocarbons such as toluene, xylene, hydrocarbons of the formula $C_nH_{2n+2}$ where n=from about 5 to 20, and liquids capable of dissolving ionizable molecular species or electrolytes. Dissolved salts in effective amounts, such as from about 0.5 to about 20 percent in embodiments, can be added such as, for example, those represented by the general formula $M^+X^-$, where $M^+$is a positively charged molecular species such as $H_3O^+$, $Li^+$, $Na^+$, $K^+$, $Rb^+$, $Cs^+$, $Be^{2+}$, $Mg^{2+}$, $Ca^{2+}$, $Sr^{2+}$, $Ba^{2+}$, transition metal cations like $Fe^{2+}$, $Co^{2+}$, $Ni^{2+}$, $Cu^{2+}$, $Zn^{2+}$, lanthanide cations, ammonium, alkylammonium, alkylarylammonium, tetraphenylarsonium, tetraphenylphosphonium, pyridinium, piperidinium, imidazolinium, guanidinium, polymeric cations like polyvinylpyridinium, and $X^-$is a negatively charged molecular species such as $F^-$, $Cl^-$, $Br^-$, $I^-$, $HF_2^-$, $ICl^{2-}$, $SO_4^{2-}$, $SO_3^{2-}$, $HSO_4^-$, $CO_3^{2-}$, $HCO_3^-$, $NO_3^-$, $NO_2^-$, $ClO_4^-$, $BrO_4^-$, $PF_6^-$, $SbF_6^-$, $AsF_6^-$, $AsO_4^{3-}$, $As_2O_7^{4-}$ $BO_2^-$, $BrO_3^-$, $ClO_3$, $BeF_4^{2-}$, $Fe(CN)_6^{3-}$, $Fe(CN)_6^{4-}$, $FSO_3^-$, $GeO_3^{2-}$, $OH^-$, $IO_3^-$, $IO_4^-$, $IO_6^{5-}$, $MnO_4$, $MnO_4^{2-}$, $SeO_4^{2-}$, $SeO_2^{2-}$, $SiO_3^{2-}$, $SiO_4^{4-}$, $TeO_4^{2-}$, $SCN^-$, $OCN^-$, $WO_4^{2-}$, $VO_3$–, $VO_4^{3-}$, $V_2O_7^{4-}$ $SiF_6^-$, phosphate, hypophosphate, metaphosphate, orthophosphate, metatungstate, paratungstate, molybdotungstate molybdate, and anionic inorganic complexes, acetate, adipate, alkanoate, benzenesulfonate benzoate, camphorate, cinnamate, citrate, formate, fumarate, glutamate, lactate, maleate, oleate, oxalate, phenoxide, phthalate, salicylate, succinate, tartrate, triflate, trifluoracetate, toluenesulfonate, the polymeric anions polyacrylates, or polystyrenesulfonate, and the like.

Specific examples of added salts include $Na_2CO_3$, $NaHCO_3$, $NaClO_4$, $LiClO_4$, $Na_2SO_4$, LiCl, NaCl, KCl, RbCl, CsCl, MgCl2, CaCl2, tetraethylammonium chloride, tetraethylammonium bromide, tetraethylammonium iodide, tetraethylammonium perchlorate, tetrabutylammonium perchlorate, cetylpyridinium chloride, or polyvinylpyridinium chloride.

Ionically conductive liquids include aqueous solutions of $Na_2CO_3$, $NaHCO_3$, $NaClO_4$, $LiClO_4$, $Na_2SO_4$, LiCl, NaCl, KCl, RbCl, CsCl, $MgCl_2$, $CaCl_2$, tetraethylammonium chloride, tetraethylammonium bromide, tetraethylammonium iodide, tetraethylammonium perchlorate, or solutions of tetrabutylammonium perchlorate, tetraethylammonium toluenesulfonate, cetylpyridinium chloride, polyvinylpyridinium chloride in ethyl alcohol, isopropyl alcohol, dichloromethane, acetonitrile. The concentration range can be from a trace level to saturation. The fluid can also be an ethanolic solution of tetraalkylammonium halide where halide is fluoride, chloride, bromide, iodide, tetraalkylammonium perchlorate, tetraalkylammonium sulfate, tetraalkylammonium p-toluenesulfonate and the like in concentrations from trace to saturation. The fluid can also be an alkane such as hexane, hexadecane or NORPAR 15™ containing CaAOT (AOT is dioctylsulfosuccinate), HBR-Quat salt, ALOHAS electrolytes or mixtures thereof.

The ionically conductive fluid comprised of carrier fluid and electrolyte can be contacted by the layered photoreceptor by a number of different methods. The fluid itself may be directly contacted with the photoreceptor surface by allowing it to impinge upon the surface through a slot in the container reservoir. The fluid is sealed from leaking out of the reservoir by a lubricated rubber gasket or shoe. The rubber is selected to conform to asperities in the photoreceptor surface and to any curvature in the photoreceptor, such as a drum. Any droplets which may transfer to the surface can be wiped away by a wiper blade, for example. Electrical contact can be made to the ionically conductive fluid either by immersing a wire into the fluid, if the fluid container is comprised of an electrically insulating material, or by applying a voltage directly to the fluid container, when it is comprised of a conductive material.

The ionically conductive fluid can also be contacted to the surface by imbibing an absorbant charging blade with the fluid and the blade is contacted with the surface of the imaging member in the wiping mode. The blade can be comprised of an absorbant felted material, or an open cell foam, for example. The charging blade is mounted onto a support and is continually moistened from a reservoir containing the ionically conductive fluid. A wiper blade can be located downstream in the process direction of the ionically conductive blade, insuring that droplets of ionically conductive fluid do not transfer to the surface of the imaging member. Electrical contact to the fluid wetted felt or foam blade can be made by placing a metal contact or wire against it. The voltage is then applied to this contact. Alternatively, the voltage may be applied to the support material when it is comprised of an electrically conductive material.

An additional method for implementing a liquid ionic contact charging device involves a metering roll. The ionically conductive fluid, preferably water, is contained in a reservoir and is applied to the metering roll by a wick so that the metering roll is wetted by a thin layer of the fluid, the layer thickness being a few microns, for example from about 1 to about 3 microns in embodiments. The metering roll can instead be in direct contact with the ionically conductive fluid and should be compliant to make good contact with the surface of the imaging member. The metering roll surface should be hydrophilic and can be comprised of an electrically conductive or electrically insulating material.

A stiff shaft serves as the core onto which is coated an elastomeric polymer like polyurethane which provide compliancy for the roller. A polyurethane foam can be used as well to provide a compliant base. The elastomeric layer is then coated with a thin smooth impermeable polymeric layer preferably 0.5 mil to 5 mil thick which need not be ionically conductive. This layer should be wettable, preferably hydrophilic, by the fluid which is preferably water. The hydrophilic polymer layer can be a hydrophilic polymer such as a hydrogel (polyhydroxyethylmethacrylate, polyacrylates, polyvinylpyrrolidinone and the like).

Alternatively, the elastomeric layer can be a hydrophobic polymer, for example VITON®, a copolymer of vinylidene fluoride/hexafluoropropylene, or terpolymers of vinylidene fluoride/hexafluoropropylene and tetrafluoroethylene. Its surface can be chemically treated so as to make it hydrophilic. For example, it may be treated by exposure to ozone gas, or other oxidizing agents such as chromic acid. Yet another way of making a surface, such as VITON®, hydrophilic is to roughen it, for example by sanding it with fine sand paper.

The surface of the metering roll may alternatively be rendered hydrophilic by filling the thin layer which overcoats the compliant base described above with finely divided conductive particles, such as aluminum, zinc or oxidized carbon black, aluminum oxide, tin oxide, titanium dioxide, zinc oxide and the like, to the extent of 0.1 to 10 percent. Both the conductive and semiconductive particles can be embedded in the surface layer of the elastomer by heating the elastomer above its glass transition temperature or by depositing a layer of adhesive onto the elastomer and spraying the particles onto the surface. The thickness of this layer can be from 0.1 micron to 100 microns, and preferably is from about 10 to about 50 microns with a hardness of from about 10 A to about 60 A on the Shore Adurometer Scale.

One Mechanism of Operation:

Pure water which is equilibrated with a pure carbon dioxide atmosphere contains dissolved carbon dioxide to the extent of 0.033 percent. Carbon dioxide is soluble to the extent of 0.14 gram per 100 milliliters of water. However, pure water which is equilibrated with ambient atmosphere contains 17 milliliters of dissolved air at standard temperature and pressure. The pH of air equilibrated distilled water is about 5.5 because of the aqueous hydrolysis of $CO_2$ in water represented by the chemical equations:

$$CO_2+H_2O=HCO_3^-+H_3O^+$$

$$HCO_3^-+H_2O=CO_3^{2-}+H_3O^+$$

The aqueous hydrolysis of carbon dioxide dramatically decreases the ionic resistivity of pure water from about 18 megohms to about 100 kilohms for pure air-equilibrated water. Air-equilibrated water contains the ionic species hydronium ion, bicarbonate ion, carbonate ion, and to a small extent hydroxide ion. Thus, under negative applied voltages, bicarbonate and/or carbonate ion are predominantly transferred to the photoreceptor surface. Conversely, under positive applied voltages, hydronium ion is transferred to the surface. Thus, pure water, water based fluids and fluids mixed with water are expected to be ionically conductive. The conductivity is dominated by the ions just described.

One advantage of ion transfer relative to a corotron is that ozone production is significantly reduced when charging layered imaging members. Contact ionic charging produces less than 10 percent of the ozone that a corotron produces. At voltages between –800 volts and 800 volts, a corona is not visually observable in a completely darkened room with the process of the present invention. Also, the odor of ozone is not detectable with the process of the present invention. Since organic photoreceptors are usually charged to less than –800 volts, ion transfer charging of the present invention is for all practical purposes ozoneless. This eliminates one photoreceptor degradation mechanism, that is a print defect commonly known as parking deletions. In addition the need for ozone management and filtration is mitigated. Thus, ionic charging devices present a lower health hazard than a corotron or scorotron.

Another advantage of the processes of the present invention is that the complexity of the power supply can be diminished since, for example, a DC only bias may be needed. The power supply should be simpler than commercial bias charge rollers which use an AC signal superimposed onto a DC signal. In addition, the voltages needed are lower than other charging devices. Yet another advantage is cost. The ion transfer charging can reduce the cost by up to $18. The simplicity of construction will have cost advantages over the more complex (higher parts count) of the scorotron. Another advantage is speed. The process is capable of uniformly charging a photoreceptor surface up to 20 inches per second.

Yet another advantage of the processes of the present invention is the high degree of charge uniformity. The variation in surface voltage is plus or minus 1 to 2 volts over a MYLAR™ surface, a surface which retains charge. Accomplishing this test on a photoreceptor was considered impractical because of the dark decay issues.

Numerous different photoreceptors, and preferably layered photoresponsive imaging members can be charged with the processes of the present invention. In embodiments, thus the layered photoresponsive imaging members to be charged are comprised of a supporting substrate, a charge transport layer, especially an aryl amine hole transport layer, and situated therebetween a photogenerator layer comprised, for example, of titanyl phthalocyanine of Type IV, Type I, or Type X, with Type IV being preferred. A positively charged layered photoresponsive imaging member that may be selected for charging can be comprised of a supporting substrate, a charge transport layer, especially an aryl amine hole transport layer, and as a top overcoating a photogenerating pigment layer with optional layers, such as adhesive layers, therebetween.

The photoresponsive imaging members can be prepared by a number of known methods, the process parameters and the order of coating of the layers being dependent on the member desired. The imaging members suitable for positive charging can be prepared by reversing the order of deposition of photogenerator and hole transport layers. The photogenerating and charge transport layers of the imaging members can be coated as solutions or dispersions onto selective substrates by the use of a spray coater, dip coater, extrusion coater, roller coater, wire-bar coater, slot coater, doctor blade coater, gravure coater, and the like, and dried at from 40° to about 200° C. for from 10 minutes to several hours under stationary conditions or in an airflow. The coating is accomplished to provide a final coating thickness of from 0.01 to about 30 microns after it has dried. The fabrication conditions for a given layer can be tailored to achieve optimum performance and cost in the final device.

A negatively charged photoresponsive imaging member to be charged can be comprised in the order indicated of a supporting substrate, a solution coated adhesive layer comprised, for example, of a polyester 49,000 resin available from Goodyear Chemical, a photogenerator layer comprised, for example, of metal phthalocyanines, metal free phthalocyanines, perylenes, titanyl phthalocyanines, vanadyl phthalocyanines, selenium, trigonal selenium, and the like, optionally dispersed in a resin binder, and a hole transport layer comprised of, for example, an aryldiamine like N,N'-diphenyl-N,N'-bis(3-methyl phenyl)-1,1'-biphenyl- 4,4'-diamine, dispersed in a polycarbonate resinous binder.

A positively charged photoresponsive imaging member to be charged is comprised of a substrate, a charge transport layer comprised of N,N'-diphenyl-N,N'-bis(3-methylphenyl)-1,1' -biphenyl-4,4'-diamine dispersed in a polycarbonate resinous binder, and a photogenerator layer optionally dispersed in an inactive resinous binder.

Substrate layers selected for the imaging members can be opaque or substantially transparent, and may comprise any suitable material having the requisite mechanical properties. Thus, the substrate may comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid and many have a number of many different configurations, such as for example a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The thickness of the substrate layer depends on many factors, including economical considerations, thus this layer may be of substantial thickness, for example over 3,000 microns, or of minimum thickness providing there are no adverse effects on the system. In embodiments, the thickness of this layer is from about 75 microns to about 300 microns.

Generally, the thickness of the photogenerator layer depends on a number of factors, including the thicknesses of the other layers and the amount of photogenerator material contained in this layer. Accordingly, this layer can be of a thickness of from about 0.05 micron to about 10 microns when the photogenerator pigment composition is present in an amount of from about 5 percent to about 100 percent by volume. In embodiments, this layer is of a thickness of from about 0.25 micron to about 1 micron when the photogenerator composition is present in this layer in an amount of 30 to 75 percent by volume. The maximum thickness of this layer in an embodiment is dependent primarily upon factors, such as photosensitivity, electrical properties and mechanical considerations. The charge generator layer can be obtained by dispersion coating the photogenerating pigment and a binder resin with a suitable solvent. The binder may be omitted. The dispersion can be prepared by mixing and/or milling the pigment in equipment such as paint shakers, ball mills, sand mills and attritors. Common grinding media, such as glass beads, steel balls or ceramic beads, may be used in this equipment. The binder resin may be selected from a number of known polymers such as poly(vinyl butyral), poly(vinyl carbazole), polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and the like. The solvents to dissolve these binders depend upon the particular resin. In embodiments of the present invention, it is desirable to select solvents that do not effect the other coated layers of the device. Examples of solvents useful for coating the photogenerating pigment dispersions to form a photogenerator layer are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethylformamide, dimethylacetamide, butyl acetate, ethyl acetate, methoxyethyl acetate, and the like.

The coating of the photogenerating pigment dispersion in embodiments of the present invention can be accomplished with spray, dip or wire bar methods such that the final dry thickness of the charge generator layer is from 0.01 to 30 microns and preferably from 0.1 to 15 microns after being dried at 40° to 150° C. for 5 to 90 minutes.

Illustrative examples of polymeric binder resinous materials that can be selected for the photogenerator pigment include those polymers as disclosed in U.S. Pat. No. 3,121,006, the disclosure of which is totally incorporated herein by reference.

As adhesives usually in contact with the supporting substrate, there can be selected various known substances inclusive of polyesters, polyamides, poly(vinyl butyral), poly(vinyl alcohol), polyurethane and polyacrylonitrile. This layer is of a thickness of from about 0.05 micron to 1 micron. Optionally, this layer may contain conductive and nonconductive particles such as zinc oxide, titanium dioxide, silicon nitride, carbon black, and the like to provide, for example, in embodiments of the present invention desirable electrical and optical properties.

Aryl amines selected for the hole transporting layer which generally is of a thickness of from about 5 microns to about 75 microns, and preferably of a thickness of from about 10 microns to about 40 microns, include molecules of the following formula

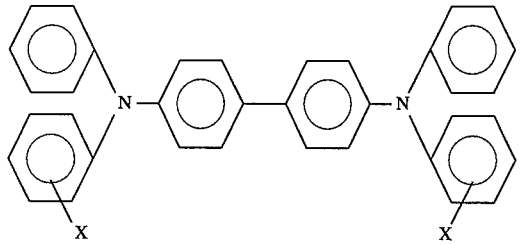

dispersed in a highly insulating and transparent organic resinous binder wherein X is an alkyl group or a halogen, especially those substituents selected from the group consisting of (ortho) $CH_3$, (para) $CH_3$, (ortho) Cl, (meta) Cl, and (para) Cl.

Examples of specific aryl amines are N,N'-diphenyl-N,N'-bis(alkylphenyl)-1,1-biphenyl-4,4'-diamine wherein alkyl is selected from the group consisting of methyl, such as 2-methyl, 3-methyl and 4-methyl, ethyl, propyl, butyl, hexyl, and the like. With chloro substitution, the amine is N,N'-diphenyl-N,N'-bis(halophenyl)-1,1'-biphenyl-4,4'-diamine wherein halo is 2-chloro, 3-chloro or 4-chloro. Other known charge transport layer molecules can be selected, reference for example U.S. Pat. No. 4,921,773 and 4,464,450, the disclosures of which are totally incorporated herein by reference.

Examples of the highly insulating and transparent resinous material or inactive binder resinous material for the transport layers include materials, such as those described in U.S. Pat. No. 3,121,006, the disclosure of which is totally incorporated herein by reference. Specific examples of organic resinous materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binders are comprised of polycarbonate resins having a molecular weight of from about 20,000 to about 100,000 with a molecular weight of from about 50,000 to about 100,000 being particularly preferred. Generally, the resinous binder contains from about 10 to about 75 percent by weight of the active charge transport material, and preferably from about 35 percent to about 50 percent of this material.

Also, included within the scope of the present invention are methods of imaging and printing with the photoresponsive devices illustrated herein. These methods generally involve the formation of an electrostatic latent image on the imaging member, followed by developing the image with a toner composition, reference U.S. Pat. No. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

In embodiments, the photoreceptor is charged by wetting a foam component contained in a metal, such as brass vessel with wedging rods that attach the foam to the vessel. The photoreceptor is placed within close proximity of the brass vessel and the foam contacts the imaging member. The foam is also in contact with the brass vessel or container. A power source is connected to the vessel and a voltage is applied to the foam, which voltage can range, for example, from about 200 to about 800 volts. This voltage causes the $HCO_3^-$ and $H_3O^+$ions in the water to separate. When a positive voltage is applied from the power source, positive ions migrate toward the imaging member, and when a negative voltage is applied from the power source negative ions migrate toward the imaging member. Rotation or translation of the imaging member causes charge to transfer from the foam to the imaging member, and which charge is substantially equivalent or equivalent to the voltage applied from the power source. The imaging member in embodiments is rotating at speeds of, for example, about 100 inches per second and preferably from zero to about 50 inches per second and more preferably about 0.5 to 50 inches per second. The aforementioned is believed caused primarily by the known dissolution of carbon dioxide in water.

In another embodiment, there can be selected for accomplishing the process of the present invention a polyethylene beaker containing an ionically conductive fluid, such as water, and wherein the beaker is connected to a power source. Power supplied to the fluid in the beaker generates ions as indicated herein and these ions migrate to the imaging member and charge it at, for example, from about −3,000 volts to about +30,00 volts, and preferably from about ±400 to about ±700, respectively, and more preferably from about −635 to about −675 volts.

The following Examples are being provided to further define various species of the present invention, and these Examples are intended to illustrate and not limit the scope of the present invention. Parts and percentages are by weight unless otherwise indicated.

EXAMPLE I

An aluminized MYLAR® substrate, 2 mils thick, 3 inches wide and 19 inches in length, was taped onto an aluminum drum which was 3 inches wide and 6 inches in diameter. The aluminized side of the MYLAR® film was contacted with the aluminum drum surface forming a ground plane. The rotation speed of the drum was electronically controlled so that the circumferential velocity was variable from about 2 inches per second to about 15 inches per second. A plastic beaker was placed beneath the drum at the "six o'clock" position and filled with municipal tap water. The level of the water was higher than the edge of the beaker forming a meniscus. A copper wire was placed through the wall of the beaker and the hole sealed with a silicone polymer. The end of the copper wire was bare so that the voltage could be applied to the water inside the beaker. The voltage was applied by a Trek Corotrol power supply which was capable of supplying either positive or negative voltages. An electrostatic voltmeter was mounted at the "three o'clock" position to detect the surface voltage on the MYLAR® surface.

The high surface tension of the water (72 mN/m) not only allows the plastic beaker to be overfilled, but also prevents wetting of the MYLAR® surface. Thus, upon rotation the drum passes through the water meniscus, but the water does not wet the MYLAR® surface. Care was taken to insure that the water meniscus did not wet the edges of the drum in order to avoid short circuiting to the ground plane. A voltage of −800 volts was applied to the water in the beaker, and then the drum was rotated counterclockwise at about 3 inches per second for a quarter to a half of a turn and stopped. A reading was taken from the electrostatic voltmeter and recorded. The applied voltage was then varied from −1,500 volts to +1,500 volts and, following the above procedure, the electrostatic surface voltage was recorded at several applied voltages, $V_{app}$.

A plot of the electrostatic surface voltage versus the voltage applied to the water reservoir is shown in FIG. 1. The voltage developed on the MYLAR® surface is, within a few tenths of a percent, the same as the voltage applied to the water reservoir. Both positive and negative voltages are developed on the MYLAR® surface with virtually 100 percent voltage efficiency. The linear curvature of the plot in FIG. 1 is indicative of charging by the transfer of ions. That charging which occurs at voltages less than the minimum of the Paschen curve (about 400 volts) indicates that the charging mechanism does not involve air breakdown (corona) but rather involves a transfer of ions at the liquid/MYLAR® interface.

Measurement of Charge Transfer Uniformity:

The measurement of charge transfer uniformity was conducted at a $V_{app}$=−800 volts. The water reservoir was then removed and the drum was rotated at 2 inches per second while measuring the surface voltage using the ESV. The voltage readings on the MYLAR® showed a plus or minus 2 volts variation in the circumferential direction of the drum. The charge transfer uniformity was also measured by moving the ESV on a precision translation stage. The variation in surface charge in the lateral direction from −800 volts was plus or minus 2 volts.

EXAMPLE II

Charging by Other Liquids:

The charging characteristics of other liquids were also investigated by a procedure of Example I. Distilled deionized water was used as an example of a liquid that contains no purposely added ions. This water was purified by successive filtration through a reverse osmosis filter, a carbon filter to remove organic materials, and two deionizing filters. The water was then distilled under high purity argon from an alkaline permanganate reservoir. This was followed by a second distillation. The purified water was stored under an ultrahigh purity argon atmosphere. The charging characteristics of distilled water were substantially identical to tap water. This was due to the aqueous hydrolysis of dissolved carbon dioxide gas which yielded dissolved bicarbonate and carbonate ions as well as hydronium ions. The resistivity of the purified water in equilibrium with ambient air was about 100 kilohms. Other aqueous media can be used to charge MYLAR®, including Coke® Classic and Pepsi® brand soft drinks. These charge the surface with about the same efficiency as tap water.

EXAMPLE III

As an example, NORPAR 15™, a straight chain aliphatic hydrocarbon (chain length is about C15 sold by Exxon Chemical Corporation, Houston, Tex.), was used to charge aluminized MYLAR®. The hydrocarbon contained ≦5 weight percent ionizable charge directors, such as barium petronate or a surfactant of HBr Quat, comprised of 80 mole percent of 2-ethylhexylmethacrylate and 20 mole percent of dimethylaminoethyl methacrylate hydrobromide. NORPAR® solutions containing the latter and the former both charged the surface efficiently, that is about 100 percent. The charging curve for NORPAR® containing either barium petronate or HBr Quat is indistinguishable from that of FIG. 1.

EXAMPLE IV

Figure 2:
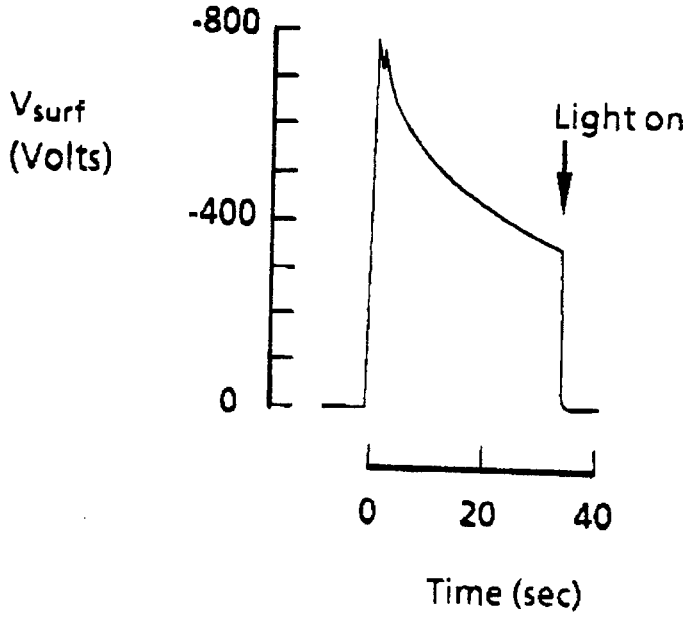
FIG. 2 is a graph of charging of a multilayered photorecptor with electrified water under negative bias.
Figure 3:
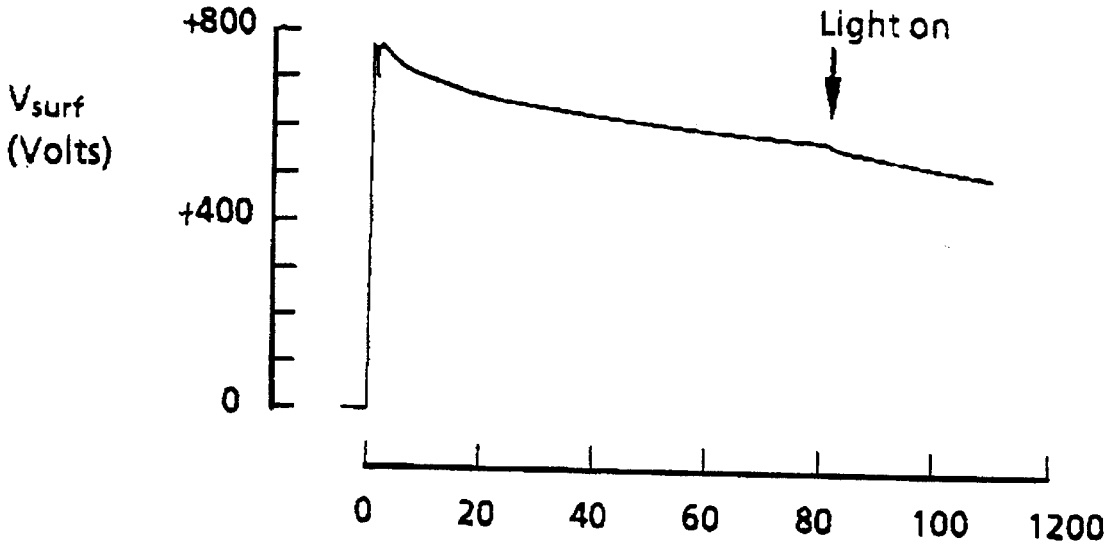
FIG. 3 is a graph of charging of a multilayered photoreceptor with electrified water under positive bias.

Charging a Photoreceptor:

A commercially available Xerox Corporation photoreceptor was used to demonstrate that photoreceptor surfaces could be charged by the aqueous ion transfer technique. The photoreceptor was comprised of an aluminized MYLAR® ground plane overcoated with a trigonal selenium photogenerating layer, 90 percent, in a PVK binder, 10 percent, which was in turn coated with a layer comprised of N,N'-diphenyl-N,N'-bis(3-methylphenyl)- 1,1'-biphenyl-4,4'-diamine, dispersed in a polycarbonate resinous binder. A part of the photoreceptor was sectioned (same dimensions as in Example I) such that the ground plane edge strip was electrically contacted to an aluminum drum. The photoreceptor section was taped tightly to the drum so that only the transport layer was exposed to the water in the water reservoir, that is there was no possibility for electrical short circuits to be formed. A bias of −800 volts was then applied to the water reservoir and the drum rotated at 2 inches per second until the charged area of the photoreceptor came under the electrometer. At this point, the imaging member rotation was halted. The surface potential on this spot of the photoreceptor surface was then measured as a function of time as shown in FIG. 2. This graph illustrates that the surface initially charged to about −750 volts. This is less than the −800 volts expected of a perfect insulator because of the dark decay of the photoreceptor which occurs during the time between charging at the six o'clock position and ESV at the three o'clock position, 90° later in the cycle. The dark decay was allowed to continue for about 35 seconds. The dark decay rate was found to be characteristic of this type of photoreceptor. Exposure to light from a fluorescent lamp rapidly dropped the surface potential to near zero volts as indicated by the arrow in FIG. 2. The above charge/dark decay/discharge behavior was characteristic of this photoreceptor when it was charged negatively by a corotron. The P/R (layered imaging member) was then charged to +800 volts and the dark decay was measured, reference FIG. 3.

A much slower dark decay rate was observed. The surface potential was not effected (discharged) significantly by exposure to light. This behavior was characteristic of this photoreceptor when it was charged positively by a corotron. Thus, it can be concluded that charging and discharging behavior of the photoreceptor is indifferent to the means of charging, be it ion transfer or corona discharge. This is a distinct advantage as it allows for the facile substitution of a corotron with a liquid ion contact charging device.

EXAMPLE V

Developability of the Surface Charge:

A MYLAR® surface was charged as in Example I to a voltage of +500 volts. The surface charge on MYLAR® is known to be stable for very long periods of time (days). The MYLAR® was removed from the drum fixture and immediately fitted into a toner developing fixture. A negative charging polyester toner containing 1 weight percent of potassium tetraphenylborate charge control agener, and cyan pigment, available as MAJESTIK toner from Xerox Corporation was then developed onto the charged MYLAR® surface to determine the lateral uniformity of the transferred ionic charge and whether the surface charge would in fact allow toner to adhere electrostatically to the MYLAR® surface. A uniform even coating of toner was indeed transferred to the MYLAR® surface. The solid area image was fixed by heating to 120° C. in a convection oven for several seconds.

What is claimed is:

1. A process for charging layered imaging members by the transfer of ions thereto from an ionically conductive gel medium.

2. A process in accordance with claim 1 wherein the gel is a hydrogel of a polyacrylate, polyacrylamide, polyvinylether, polypyrrolidinone, or polyhydroxyethylmethacrylate.

3. A process in accordance with claim 1 wherein the conductive medium is comprised of an ionically conductive solid.

4. A process in accordance with claim 1 wherein ion charges of a negative polarity, or ion charges of a positive polarity are transferred.

5. A process in accordance with claim 1 wherein a voltage is applied to the gel.

6. A process in accordance with claim 1 wherein said members are comprised of organic photoconductive imaging members.

7. A process in accordance with claim 6 wherein the organic photoconductive imaging members are comprised of a supporting substrate, a photogenerating layer and a charge transport layer.

8. A process in accordance with claim 1 wherein the imaging members are in contact with the ionically conductive gel medium.

9. A process in accordance with claim 1 wherein the imaging members are moved while in contact with the ionically conductive gel medium.

10. A process in accordance with claim 9 wherein movement is by rotation of said imaging members.

11. A process in accordance with claim 9 wherein movement is accomplished by a belt.

12. A process in accordance with claim 1 wherein there are further included in said ionically conductive gel medium solid salts of the formula $M^+X^-$, where $M^+$is a positively charged organic or inorganic molecular species, and $X^-$is a negatively charged organic or inorganic molecular species, and ozone emersion is avoided.

13. An ozone free process for the ionic conduction charging of photoconductive imaging members which comprises contacting an ionically conductive liquid and wherein said liquid is comprised of water with the surface of the imaging member, and applying a voltage to the water while moving the imaging member thereby enabling the transfer of ions to said member, wherein movement is by rotation at high speeds of from about 0.1 inch to about 50 inches per second of said imaging members, transfer of ions results from the application of an electric field or an impressed voltage across the water imaging member interface, and the water is delivered to the imaging member by sponge, a open cell foam, a roll, a blade, and/or a wick, and wherein said water is distilled water wherein the liquid is delivered to the imaging member by a sponge, an open cell foam, a roll, a blade and/or a wick.

* * * * *